US008611576B2

(12) United States Patent
Borgmann et al.

(10) Patent No.: US 8,611,576 B2
(45) Date of Patent: Dec. 17, 2013

(54) ADAPTIVE NOISE GENERATING DEVICE

(75) Inventors: Udo Borgmann, Braunschweig (DE); Hans-Rudolf Germann, Winkel (CH)

(73) Assignee: Preform GmbH, Feuchtwangen (DE)

( * ) Notice: Subject to any disclaimer, the term of this patent is extended or adjusted under 35 U.S.C. 154(b) by 44 days.

(21) Appl. No.: 13/002,215

(22) PCT Filed: Jun. 24, 2009

(86) PCT No.: PCT/EP2009/004561
§ 371 (c)(1),
(2), (4) Date: May 13, 2011

(87) PCT Pub. No.: WO2010/000411
PCT Pub. Date: Jan. 7, 2010

(65) Prior Publication Data

US 2011/0211721 A1 Sep. 1, 2011

(30) Foreign Application Priority Data

Jul. 3, 2008 (EP) ..... 08012021

(51) Int. Cl.
*H04R 1/20* (2006.01)
*H04R 1/00* (2006.01)

(52) U.S. Cl.
USPC ..... 381/345; 381/431

(58) Field of Classification Search
USPC ..... 381/71.1, 73.1, 94.1, 110, 150
See application file for complete search history.

(56) References Cited

U.S. PATENT DOCUMENTS

| | | | | |
|---|---|---|---|---|
| 3,449,531 | A | 6/1969 | Ashworth | |
| 3,636,281 | A | 1/1972 | Cozart | |
| 3,728,497 | A | 4/1973 | Komatsu | |
| 4,098,370 | A | 7/1978 | McGregor et al. | |
| 4,214,298 | A * | 7/1980 | Propst et al. | 362/253 |
| 4,953,220 | A * | 8/1990 | Murayama et al. | 381/86 |
| 5,692,053 | A | 11/1997 | Fuller et al. | |
| 5,719,945 | A | 2/1998 | Fuller et al. | |
| 5,748,748 | A | 5/1998 | Fischer et al. | |
| 5,781,640 | A | 7/1998 | Nicolino, Jr. et al. | |
| 6,545,418 | B1 * | 4/2003 | Kolpasky et al. | 315/77 |
| 7,283,636 | B2 * | 10/2007 | Nishimura et al. | 381/152 |
| 7,689,198 | B2 * | 3/2010 | Deng et al. | 455/345 |
| 2006/0147051 | A1 * | 7/2006 | Smith et al. | 381/71.2 |

(Continued)

FOREIGN PATENT DOCUMENTS

| | | | |
|---|---|---|---|
| DE | 484872 | C | 2/1929 |
| EP | JP0083718 | A1 | 7/1983 |

(Continued)

OTHER PUBLICATIONS

European Search Report issued in EP Application No. 08012021, completed Sep. 17, 2008, 6 pages.

(Continued)

*Primary Examiner* — Brian Ensey
*Assistant Examiner* — Norman Yu
(74) *Attorney, Agent, or Firm* — Faegre Baker Daniels LLP

(57) ABSTRACT

An acoustic adaptive noise generating device in the form of a flat panel loudspeaker is suitable for increasing people's powers of concentration in acoustically difficult surroundings. The adaptive noise generating device includes a carrier panel, an actuator arranged on the carrier panel. A control device is connected to the actuator and permits adjustment of noise signals emitted by the actuator.

11 Claims, 2 Drawing Sheets

(56) References Cited

U.S. PATENT DOCUMENTS

| | | | | |
|---|---|---|---|---|
| 2008/0144850 | A1 | 6/2008 | Abe et al. | |
| 2009/0208025 | A1 * | 8/2009 | Hayashi et al. | 381/71.4 |
| 2010/0284546 | A1 * | 11/2010 | DeBrunner et al. | 381/71.2 |

FOREIGN PATENT DOCUMENTS

| | | | |
|---|---|---|---|
| EP | 0335153 | A2 | 10/1989 |
| EP | 1740014 | A1 | 1/2007 |
| JP | 4113946 | A | 4/1992 |
| JP | 2005280546 | A | 10/2005 |
| WO | WO9709842 | A2 | 3/1997 |
| WO | WO0167808 | A1 | 9/2001 |
| WO | WO2005096310 | A1 | 10/2005 |
| WO | WO 2008013184 | A1 * | 1/2008 |

OTHER PUBLICATIONS

International Search Report and Written Opinion issued in PCT/EP2009/004561, Aug. 11, 2009, 14 pages.

* cited by examiner

ADAPTIVE NOISE GENERATING DEVICE

CROSS REFERENCE TO RELATED APPLICATIONS

The present application is a national phase application of PCT application PCT/EP2009/004561 filed pursuant to 35 U.S.C. §371, which claims priority to EP 08012021.5, filed Jul. 3, 2008. The foregoing PCT and EP applications are incorporated herein by reference in their entireties.

TECHNICAL FIELD

The present invention relates to an acoustic, adaptive noise generating device that is suitable for increasing people's powers of concentration in acoustically difficult surroundings.

BACKGROUND

Flat-panel loudspeakers as such have been known for a long time, for example from DE 484 872. In the case of a flat-panel loudspeaker, a moving coil working on the electrodynamic principle is used and it is placed directly on a surface—in principle, initially of any desired size and thickness and consisting of a chosen material—and mechanically fixed thereon. If the moving coil is electrically excited by a source of sound, its vibrations are transmitted to the surface acting as a diaphragm and this surface is thus itself used as a sound-radiating surface. For an electroacoustic transducer of this generic type, there would actually be a large number of possible uses. However, if to date it has not gained widespread acceptance, apart from a few exceptions, this is due to its electroacoustic properties, in particular its transfer function.

The mechanical properties of the sound-radiating surface are important. This surface can only transmit tones or sounds when it mechanically vibrates. Apart from the mounting, i.e. the mechanical support and the place where the moving coil is fixed on it, a plate-shaped surface that is excited preferably to vibrate flexurally is in its vibration response actually already a relatively complex structure. While in the case of a commercially available loudspeaker working on the electrodynamic principle it is still largely within one's control to optimize the sound-radiating diaphragm with regard to its acoustic properties, albeit with compromises, this is not readily possible in the case of a flat-panel loudspeaker. This problem may be illustrated by means of an example: If a glass surface of a show window, on which surface a moving coil is placed, is used as a flat-panel loudspeaker, the material, shape and dimensions of the sound-radiating surface, as well as its mounting, are substantially fixed. The frequency response of the flat-panel loudspeaker in this example is thus substantially predetermined. Typically, the natural resonances of the surface utilized for the sound radiation with this material and given the dimensions of the show window cause a frequency response which is to be described—simplified—by an excessive reproduction in the range of low tones and furthermore by a rattling tendency, which is due to the influence of higher-order natural resonances still lying in the audible range. Corresponding characteristic nonlinearities also occur with other materials, such as wood or plastic materials.

As is known, for example, from U.S. Pat. No. 3,728,497, U.S. Pat. No. 3,636,281 or U.S. Pat. No. 3,449,531, efforts have been made to overcome the known disadvantages of the flat-panel loudspeaker by means of constructional measures. It has been possible to achieve certain improvements in this manner, but a fundamental solution which would have opened up a wide range of applications for the flat-panel loudspeaker has not yet been achieved by the attempts made to date.

From psychoacoustics, it is known that for intellectual work there is an increased degree of difficulty when the noise level in the working environment is increased. A further aspect is working in a room with several people sitting close to another when they are having conversations at the same time, as occurs for example in a call centre. Here, it is very disturbing when the neighbor's voice can be clearly understood. Unintentionally overhearing the contents of other people's conversations greatly affects one's own powers of concentration when doing intellectual work. Simply by not being able to clearly understand these voices will increase the quality of work owing to the improved intellectual concentration.

SUMMARY

In some embodiments, the present invention provides a system or a mask that enables effective damping of disturbing sounds, in particular in the case of difficult and reverberant acoustics.

According to some embodiments of the invention, an adaptive noise generating device in the form of a flat-panel loudspeaker includes at least one actuator arranged on a carrier panel excitable by vibrations. The emitted noise signals of the at least one actuator are adjustable via at least one control/regulating device that is connected to the actuator. With the flat panel loudspeaker according to some embodiments of the invention, sound radiation takes place from the flat panel loudspeaker to the surrounding area. Therefore, it is a so-called "open system".

In some embodiments, an amplifier for amplifying the signals coming from the control/regulating device is arranged between the control/regulating device and the actuator.

With regard to some embodiments of the control/regulating device, several alternative embodiments are conceivable here. Firstly, in some embodiments, the control/regulating device includes at least one manually adjustable switch. It is thus possible, if desired by the user, to switch on a noise preset having a randomly adjustable amplitude.

In some embodiments, the control device includes a computer, in the memory of which are stored different noise sound characteristics that can be freely selectable or altered via a preset program.

Furthermore, in some embodiments, a microphone that records dominant acoustic signals and relays them to the computer is connected upstream of the computer. In some embodiments, an analysis of these signals takes place in the computer, in which analysis the noise signal emitted is adaptable according to a preset algorithm, depending on the ambient loudness.

In some embodiments, the noise signals can be provided by a data base. This data base may also be externally arranged, so that a large number of adaptive noise generating devices can be supplied with the necessary signal by means of a data base. The noise signals are in this case transmitted from the data base to the control/regulating unit.

In some embodiments, the control/regulating unit is equipped with a transmitter or receiver and thus is controllable via radio or via infrared. The counterpart, from which the control signals are emitted, can in this case be a remote control or else a data base or computer.

In some embodiments, the carrier panel is connected to an acoustic insulating material. The acoustic insulating material is applied on the opposite side of the carrier panel on which the actuator is arranged. In some embodiments, the acoustic insulating material is connected all over the whole surface of the carrier panel. Thus, on the one hand, passive sound damping takes place, and on the other hand, the existing sound can be further actively counteracted by the actuator. In some embodiments, the acoustic insulating material is in this case selected from mineral wool, gypsum foam, melamine resin foam, polyurethane foam, aluminium foam, hemp wool, nonwoven fabrics and/or felt materials.

Furthermore, in some embodiments, the acoustic insulating material is covered by a covering material that is electronically excitable so that it illuminates, thus enabling an illumination of the covering material. The illumination of the covering material may in this case be varied over the entire color spectrum. In some embodiments, the color of the illumination is controllable via a central computer unit, so that specific colors can be separately set or else a continuous variation over the entire color spectrum is possible.

In some embodiments, the carrier panel according to the invention is configured as a wall panel, floor panel, furniture panel, room divider, cabinet panel and/or partition wall.

DETAILED DESCRIPTION

The present invention is explained in more detail with the aid of the attached figures, without limiting the invention to the parameters and specific embodiments illustrated in the figures.

Figure 1:
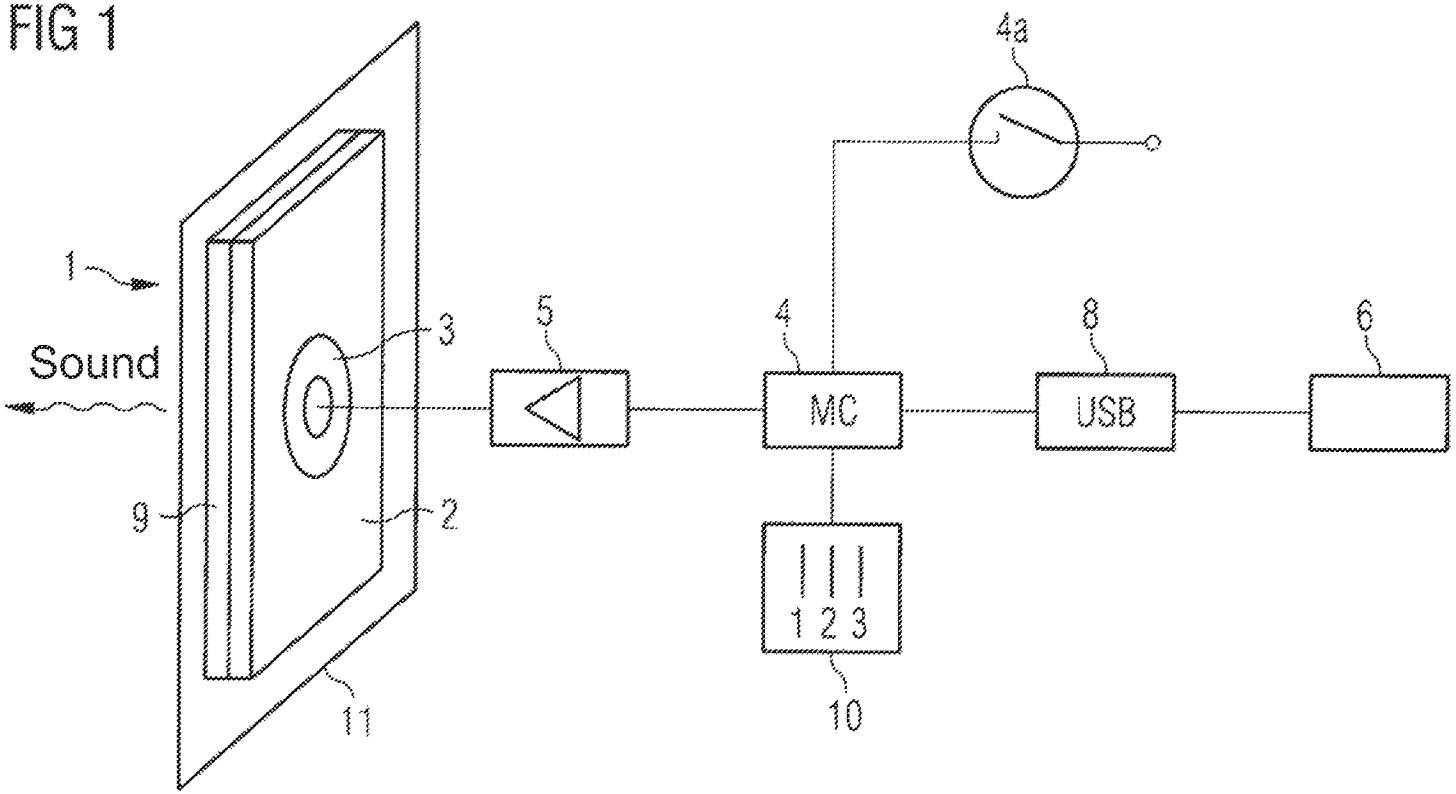
FIG. 1 is an illustration of an embodiment of an adaptive optical noise generating device.

In FIG. 1 there is illustrated an adaptive optical noise generating device 1 in the form of a flat-panel loudspeaker that includes a carrier 2 that is excitable by vibration and an acoustic insulating material 9 that is connected in a planar manner to the carrier 2. The insulating material 9 has specific acoustic properties, such as, for example, sound-absorbing properties, which fashion the acoustics in rooms, the reverberation time of a room being reduced by sound absorption. An acoustic actuator 3 is integrated centrally in the carrier 2. The direction of the sound radiation is marked with wave lines.

It is immediately obvious to a person skilled in the art of technical acoustics that the acoustic properties of the flat-panel loudspeaker 1 are determined, inter alia, by the properties of the sound-radiating carrier 2, its shape, the size of its surface, its thickness and above all also its mechanical properties, but also the configuration of the actuator 3 and its local arrangement on the sound-radiating carrier 2. Since, for example, completely different materials may be used for the sound-radiating carrier 2, a problem arises already from the choice of materials. For it depends on whether the flat-panel loudspeaker 1 exhibits high damping, as in the case of wood materials, in particular in the higher-frequency range, or on the other hand, as for example in the case of glass and also plastics, in the low-frequency range, and in the latter case reproduces high-frequency components excessively and thus tends to rattle. Owing to this problem, flat-panel loudspeakers have hitherto not gained acceptance in a large number of fundamentally possible applications, even though the principles for them have been known for a long time, because other electroacoustic transducers whose frequency response can be corrected more simply are known.

In some embodiments, the actuator 3 is connected to an audio amplifier 5 that receives its audio signals, such as, for example, noise signals, from a control or regulating device 4. This control device may have, for example, a storage medium 10, which may be a CD player for example.

In some embodiments, the system is adaptively designed and, depending on the difference of the insulating material 9 applied to the vibrating panel 2, emits different noise signals, taking into account the acoustic damping of the panel, in order to be able to emit in each case an identical noise signal with identical character.

In some embodiments, different noise signals may be locally switchable at the vibrating panel 2, for example via suitable switches 4*a*, the same sound characteristic being producible or for all embodiments the same subjective sound sensation being perceptible, always taking into account and correcting the acoustic damping properties of the material 9 applied to the panel 2. The amplitude of the acoustic signals is also adjustable via the switches 4*a*.

Furthermore, the control device 4 is connected, for example via a stationary USB connection 8, to a computing unit or a data base 6, via which the control unit 4 and/or the amplifier 5 can be controlled. Likewise, it is possible for acoustic signals, such as, for example, noise signals, which can be stored in the computing unit or the data base 6, to be fed into the control device 4. In some embodiments, the control device 4 is a microcontroller.

Also illustrated in FIG. 1 is the possibility of providing the insulating panel with a covering material 11. This covering material may be optionally excited to illuminate by the presence of appropriate illuminating sources.

Figure 2:
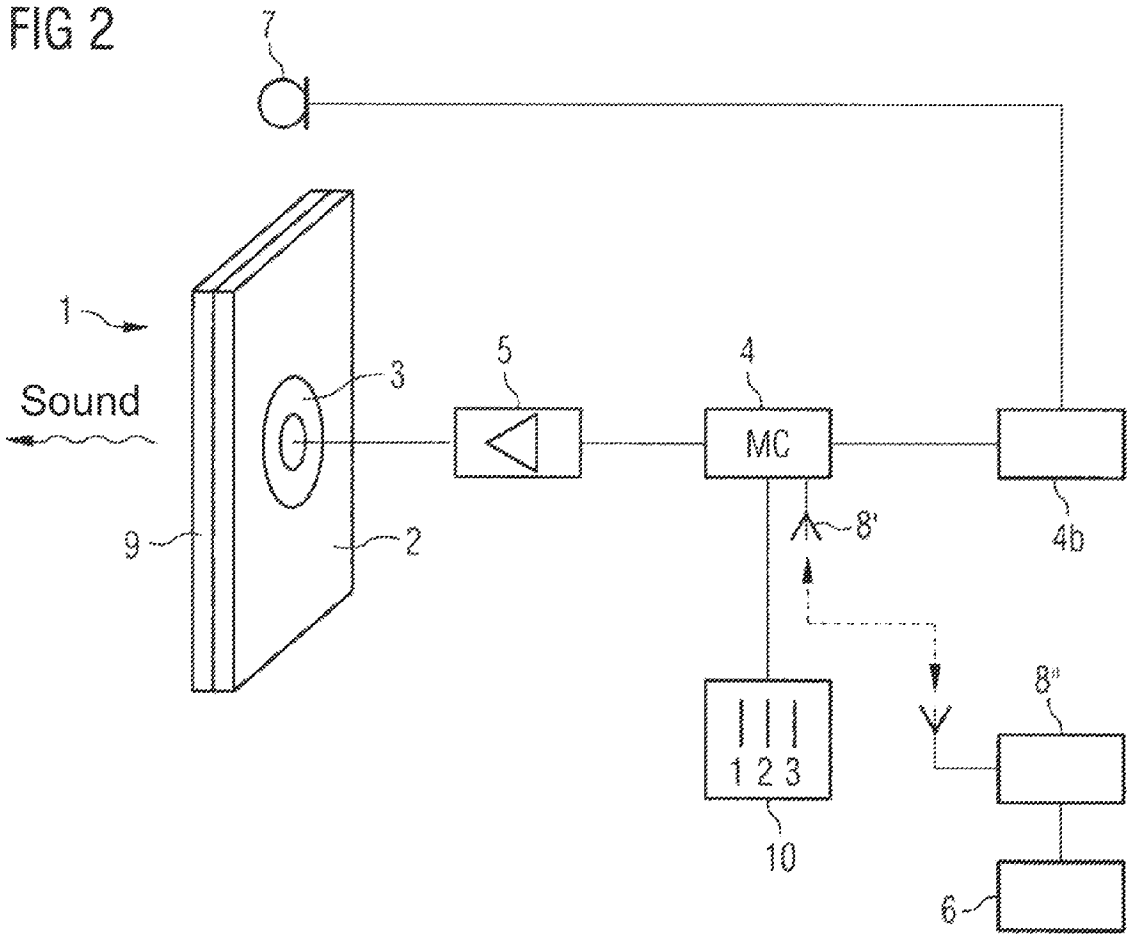
FIG. 2 is an illustration of an embodiment of an adaptive optical noise generating device.

In FIG. 2 there is illustrated a further preferred embodiment of the acoustic adaptive noise generating device 1. Here, too, the carrier 2 is provided with an acoustic insulating material 9 and is equipped with an acoustic actuator 3. In some embodiments, and as shown in FIG. 2, a microphone 7 that detects the ambient loudness is present, the microphone 7 being connected to an evaluating device 4*b*, which, for example, may be an electronic analyzing unit, such as, for example, a computer. The computer unit 4*b* analyzes the frequency spectrum and/or the loudness of the ambient acoustics detected by the microphone 7 and converts the acquired information into control signals for the control or regulating device 4.

Thus, the acoustic signals to be delivered by the actuator can be actively controlled via the computer unit 4*b* and the control device 4 with regard to their frequency spectrum and their loudness, depending on the ambient acoustics recorded by the microphone. In this case, just as already in FIG. 1, the signals delivered by the microcontroller 4 are additionally amplified via an amplifier 5. A further active control of the microcontroller 4 is in this case possible via an external computer 6, which, for example, can in some embodiments communicate with the microcontroller 4 via a radio network 8', 8". Thus, for example, the acoustic signals, such as, for example, noise signals, to be generated can be transmitted by the computer central unit or data base 6 via radio. The acoustic signals transmitted by the computer unit 6 can in this case be present in a data base stored on the computer unit 6. It is also possible for a detection or storage and analysis of the acoustic signals detected by the microphone 7 and evaluated by the computer unit 4*b* to be performed by the central computer unit 6. Logging or storage of the current or an average acoustic profile of the particular room to be exposed to sound is thus possible. It is also possible, via the external computer unit 6, to be able to overwrite or alter the locally set sound characteristics from a central location via radio, for example in view of unoccupied workplaces or for the purposes of control in day/night rhythm.

The invention claimed is:

1. An adaptive noise generating device in the form of a flat-panel loudspeaker comprising:

a carrier panel that is excitable by vibrations, the carrier panel having a first side and a second side opposite the first side;

an actuator arranged on the first side of the carrier panel;

acoustic insulator material arranged on the second side of the carrier panel and connected in a planar manner to the carrier panel;

a control device connected to the actuator such that noise signals emitted by the actuator are adjustable via the control device; and an amplifier arranged between the control device and the actuator;

wherein the carrier panel is a wall panel, a ceiling panel, a floor panel, a furniture panel, a room divider, a cabinet panel or a partition wall.

2. The adaptive noise generating device of claim 1, wherein the control device comprises a microcontroller.

3. The adaptive noise generating device of claim 1, wherein the control device includes at least one manually adjustable switch.

4. The adaptive noise generating device of claim 1, wherein the control device comprises a computer having a memory, with different noise sound characteristics that can be freely selectable or altered via a preset program stored in the memory.

5. The adaptive noise generating device of claim 1, wherein the control device comprises a computer and a microphone, and noise emitted by the actuator is adaptable according to a preset algorithm, depending on an ambient loudness.

6. The adaptive noise generating device of claim 1, wherein the noise signals are provided by a data base.

7. The adaptive noise generating device of claim 1, wherein the control device is controllable via radio.

8. The adaptive noise generating device of claim 1, further comprising:

a computer unit;

a first antenna for transmitting and/or receiving noise signals between the computer unit and the control device;

a data base; and a second antenna for transmitting and/or receiving noise signals between the data base and the control device.

9. The adaptive noise generating device of claim 1, wherein the acoustic insulating material is selected from the group consisting of mineral wool, gypsum foam, melamine resin foam, aluminum foam, polyurethane foam, hemp wool, non-woven fabrics and felt materials.

10. The adaptive noise generating device of claim 1, further comprising a covering material that is configured to be excited to illuminate, the covering material provided over the acoustic insulating material and providing an adjustable illumination.

11. The adaptive noise generating device of claim 1, wherein a color of the illumination is controllable via a central computer unit.

* * * * *